US005716914A

United States Patent [19]

Cane et al.

[11] Patent Number: 5,716,914

[45] Date of Patent: *Feb. 10, 1998

[54] ALKALINE EARTH METAL HYDROCARBYL PHENATES, THEIR SULPHURIZED DERIVATIVES, THEIR PRODUCTION AND USE THEREOF

[75] Inventors: Charles Cane, Hull; John Crawford, Caterham; Sean Patrick O'Connor, Beverley, all of England

[73] Assignee: BP International Limited, London, England

[ * ] Notice: The term of this patent shall not extend beyond the expiration date of Pat. No. 5,162,085.

[21] Appl. No.: 410,758

[22] Filed: Mar. 27, 1995

Related U.S. Application Data

[63] Continuation of Ser. No. 810,529, Dec. 18, 1991, abandoned, which is a continuation of Ser. No. 584,503, Sep. 17, 1990, abandoned, which is a continuation of Ser. No. 474,235, Jan. 31, 1990, abandoned, which is a continuation-in-part of Ser. No. 364,511, Jun. 9, 1989, abandoned, which is a continuation of Ser. No. 216,635, filed as PCT/GB87/00847 Nov. 26, 1987 published as WO88/103944 Jun. 3, 1988, abandoned.

[30] Foreign Application Priority Data

Nov. 29, 1986 [GB] United Kingdom ..... 8628609

[51] Int. Cl.[6] ..... C10M 159/22

[52] U.S. Cl. ..... 508/460; 508/574

[58] Field of Search ..... 252/18, 39; 508/460, 508/574

[56] References Cited

U.S. PATENT DOCUMENTS

| | | | |
|---|---|---|---|
| 3,372,116 | 3/1968 | Meinhardt | 252/39 |
| 3,410,798 | 11/1968 | Cohen | 252/37.2 |
| 3,493,516 | 2/1970 | Allphin et al. | 252/39 |
| 3,714,042 | 1/1973 | Greenough | 252/39 |
| 4,049,560 | 9/1977 | Dominey | 252/33.2 |
| 4,328,111 | 5/1982 | Watson et al. | 252/33.4 |
| 4,744,921 | 5/1988 | Liston | 252/39 |
| 5,069,804 | 12/1991 | Marsh et al. | 252/42.7 |
| 5,162,085 | 11/1992 | Cane et al. | 252/39 |
| 5,330,665 | 7/1994 | Cane et al. | 252/39 |
| 5,397,484 | 3/1995 | Cane et al. | 252/39 |

FOREIGN PATENT DOCUMENTS

| | | |
|---|---|---|
| 0 094 814 | 11/1983 | European Pat. Off. . |
| 0 095 322 | 11/1983 | European Pat. Off. . |
| 1440 261 | 6/1976 | United Kingdom . |
| 1 469 289 | 4/1977 | United Kingdom . |
| 1 470 338 | 4/1977 | United Kingdom . |
| 2 142 928 | 1/1985 | United Kingdom . |

*Primary Examiner*—Jerry D. Johnson
*Attorney, Agent, or Firm*—Nixon & Vanderhye

[57] ABSTRACT

Process for producing an additive concentrate having a viscosity of less than 1000 cSt at 100 EC, by reacting at elevated temperature and in the presence of an inorganic halide or calcium acetate catalyst (A) either (i) a hydrocarbyl phenol or (ii) a hydrocarbyl phenol and sulphur, (B) an alkaline earth metal base added in either a single addition or in a plurality of additions during the reaction, (C) either a polyhydric alcohol having from 2 to 4 carbon atoms, a di- or tri- $C_2$ to $C_4$ glycol, an alkylene glycol alkyl ether or a polyalkylene glycol alkyl ether, (D) a lubricating oil, (E) carbon dioxide added subsequent to the, or each, addition of compound (B), and (F) sufficient to provide from 12 to less than 40% by weight based on the weight of the concentrate of either (i) a carboxylic acid having the formula RCH(R')COOH, wherein R is a $C_{10}$ to $C_{24}$ alkyl or alkenyl group and R is either hydrogen, a $C_1$ to $C_4$ alkyl group or a —$CH_2$—COOH group, or an anhydride, acid chloride or ester thereof or (ii) a di- or polycarboxylic acid containing from 36 to 100 carbon atoms or an anhydride, acid chloride or ester thereof, the weight ratios of components (A) to (F) being such as to produce a concentrate having a TBN greater than 350.

17 Claims, No Drawings

ALKALINE EARTH METAL HYDROCARBYL PHENATES, THEIR SULPHURIZED DERIVATIVES, THEIR PRODUCTION AND USE THEREOF

This is a Rule 60 continuation application of application Ser. No. 07/810,529, filed Dec. 18, 1991, now abandoned which is a continuation of application Ser. No. 07/584,503, filed Sep. 17, 1990, now abandoned which is a continuation of application Ser. No. 07/474,235, filed Jan. 31, 1990, now abandoned which is a CIP of application Ser. No. 07/364,511, filed Jun. 9, 1989, now abandoned which is a continuation of application Ser. No. 07/216,635, filed as PCT/GB87/00847 Nov. 26, 1987 published as WO88/03944 May 3, 1988 now abandoned.

The present invention relates in general to alkaline earth metal hydrocarbyl phenates and their sulphurised derivatives, their production and use thereof as lubricating oil additives. In particular the present invention relates to concentrate additive compositions comprising alkaline earth metal hydrocarbyl phenates and their sulphurised derivatives having both a high total base number (TBN) and an acceptable viscosity, to their production and to their use as lubricating oil additives.

In the internal combustion engine, by-products from the combustion chamber often blow by the piston and admix with the lubricating oil. Many of these by-products form acidic materials within the lubricating oil. This is particularly marked in diesel engines operating on low-grade fuels of high sulphur content wherein corrosive acids are produced by combustion. The acids thereby incorporated in the lubricating oil can include sulphur acids produced by oxidation of sulphur, hydrohalic acids derived from halogen lead scavengers in the fuel and nitrogen acids produced by the oxidation of atmospheric nitrogen within the combustion chamber. Such acids cause deposition of sludge and corrosion of the bearings and engine parts leading to rapid wear and early breakdown of the engine.

One class of compounds generally employed to neutralise the acidic materials and disperse sludge within the lubricating oil are the metal alkyl phenates and sulphurised metal alkyl phenates, wherein the metal is an alkaline earth metal such as calcium, magnesium or barium. Both "normal" and "overbased" alkaline earth metal alkyl phenates have been employed. The term "overbased" is used to describe those alkaline earth metal alkyl phenates in which the ratio of the number of equivalents of the alkaline earth metal moiety to the number of equivalents of the phenol moiety is greater than one, and is usually greater than 1.2 and may be as high as 4.5 or greater. In contrast, the equivalent ratio of alkaline earth metal moiety to phenol moiety in "normal" alkaline earth metal alkyl phenates is one. Thus, the "overbased" material contains greater than 20% in excess of the alkaline earth metal present in the corresponding "normal" material. For this reason "overbased" alkaline earth metal alkyl phenates have a greater capability for neutralising acidic matter than do the corresponding "normal" alkaline earth metal alkyl phenates.

The prior art teaches many methods for preparing both "normal" and "overbased" metal alkyl phenates. One such method for preparing "overbased" alkyl phenates generally referred to as the "single lime addition" process comprises rescuing an alkyl phenol, in the presence or absence of sulphur, lubricating oil, a hydroxylic compound and excess alkaline earth metal hydroxide (above the stoichiometric proportion required to neutralise the alkyl phenol), to form an intermediate product, followed by carbonation, a heading distillation (to remove unreacted hydroxylic compound) and filtration. The production of intermediate product is accompanied by a marked increase in viscosity while the subsequent carbonation reduces the viscosity to a relatively low level. The increase in viscosity accompanying the formation of the intermediate product is undesirable because the reaction mixture becomes difficult to agitate to the detriment of subsequent reactions. Whilst this increase in viscosity may be controlled to an acceptable level by incorporation of less alkaline earth metal hydroxide in the reaction, the overbased alkyl phenate product necessarily possesses a reduced neutralisation capacity. In order to achieve a high neutralisation capacity product and at the same time control the viscosity of the intermediate product within acceptable limits, the alkaline earth metal hydroxide may be added in two, (generally referred to as the "double lime addition" process) or three separate reaction steps, with sequential carbonation steps. However, this method involves relatively long batch times. Another alternative is to use viscosity depressants, such as tridecanol, 2-ethylhexanol, or similar boiling range hydroxylic solvent, in the production of the intermediate product but such an expedient increases the raw material cost of the process. The highest total base number (TBN), expressed in mg KOH/g, consistent with an acceptable viscosity, generally achievable by prior art processes is about 300, though generally prior art TBNs are in the range from 200–300. It would clearly be a desirable objective to produce an additive concentrate comprising alkaline earth metal alkyl phenates or sulphurised derivatives thereof having a high TBN, that is a TBN greater than 300, and preferably greater than 350. To date it has not been found possible to achieve products of such high TBN because the use of larger concentrations of alkaline earth metal base leads to highly viscous products which, rather than being 'thinned' by subsequent carbonation attempts using excess carbon dioxide, are rendered insoluble. We have achieved this objective and thereby obtained products having a TBN in excess of 300, and in some cases greater than 350, whilst retaining an acceptable viscosity, that is a viscosity at 100° C. of less than 1,000 cSt and avoiding insolubility by incorporating into the reaction mixture a defined amount of certain carboxylic acids having at least 10 carbon atoms in the molecule or acid derivatives.

The use of carboxylic acids either in the production of alkaline earth metal alkyl phenates and their sulphurised derivatives or in association therewith in lubricating oil compositions is not new, see for example U.S. Pat. No. 3,372,116; GB-A-1440261; U.S. Pat. No. 4,049,560 and EP-A-0094814.

U.S. Pat. No. 3,372,116 discloses an improvement in the method for preparing a basic metal phenate by reacting at a temperature between about 25° C. and the reflux temperature (A) a hydrocarbon-substituted phenol having at least 6 carbon atoms in the hydrocarbon substituent, a mixture of said phenol with up to an equivalent amount of a hydrocarbon-substituted succinic acid or anhydride having at least about 6 carbon atoms in the hydrocarbon substituent, or a substantially neutral alkali metal or alkaline earth metal salt or either of the foregoing, (B) about 1–10 equivalents, per equivalent of (A), of a calcium or strontium base, and (C) carbon dioxide, which improvement comprises carrying out the reaction in the presence of about 0.002–0.2 equivalent, per equivalent of said calcium or strontium base, of a carboxylic acid having up to about 100 carbon atoms or an alkali metal, alkaline earth metal, zinc or lead salt thereof. The preferred carboxylic acids are those containing up to about 10 carbon atoms, more preferred being monocarboxylic acids containing up to 10 carbon atoms and alkaline earth metal salts thereof. In many of the Examples water and a carboxylate salt are employed. Not only do we wish to avoid the presence of water but we also find that carboxylate salts can not be used in the process of the present invention because of their inherent insolubility in the system. The process of U.S. Pat. No. 3,372,116 does not employ phenol to alkaline earth metal base ratios sufficient to produce phenates having TBNs in excess of 300.

GB-A-1440261 discloses a lubricating oil composition comprising a lubricating oil, a detergent or dispersant additive and a mixture of at least two carboxylic acids, one acid having a melting point of at least 20° C. and not more than 30 carbon atoms per molecule, and another acid having a melting point of below 20° C., the weight proportion of low melting point acid to high melting point acid being between 1.5:1 and 8:1. The detergent may be an overbased phenate, those having a TBN of 50 to 100 being considered very suitable. In the lubricating oil composition the mixture of acids is present in an amount of 0.05 to 2.0 wt %.

U.S. Pat. No. 4,049,560 describes the production of an overbased magnesium detergent by a process in which carbon dioxide is introduced into a reaction mixture which comprises:

(a) 15–40 wt % of a sulphurised phenol or thiophenol containing one or more hydrocarbyl substituents, or a phenol or thiophenol containing one or more hydrocarbyl substituents, or said phenol or thiophenol containing one or more hydrocarbyl substituents together with sulphur, (b) 5–15 wt % of an organic sulphonic acid, an organic sulphonate or an organic sulphate, (c) 5–15 wt % of a glycol, a $C_1$ to $C_5$ monohydric alkanol or $C_2$ to $C_4$ alkoxy alkanol, (d) 2–15 wt % of a magnesium hydroxide or active magnesium oxide, (e) at least 0.1 wt % of a $C_1$ to $C_{18}$ carboxylic acid, an anhydride thereof, or an ammonium, an amine salt, a Group I metal or a Group II metal salt of said $C_1$ to $C_{18}$ carboxylic acid, and (f) at least 10% by weight of a diluent oil (including any present in components (a) and (b).

The amount of carboxylic acid (component (e)) is preferably in the range 0.5 to 2.0% by weight. The product prepared by this reaction is said to have a TBN of about 200 to 250, e.g. about 225.

EP-A-0094814 discloses an additive concentrate for incorporation in a lubricating oil composition comprising lubricating oil, and from 10 to 90 wt % of an overbased alkaline earth metal hydrocarbyl sulphurised phenate which has been treated, either during or subsequent to the overbasing process, with from 0.1 to 10, preferably 2 to 6, wt % (based on the weight of additive concentrate) of an acid of the formula:

$$R-\underset{\underset{R^1}{|}}{CH}-COOH \qquad (I)$$

(wherein R is a $C_{10}$ to $C_{24}$ unbranched alkyl or alkenyl group, and $R^1$ is hydrogen, a $C_1$ to $C_4$ alkyl group or a —$CH_2$—COOH group) or an anhydride or a salt thereof. The object of the invention of EP-A-0094814 is to overcome problems encountered with many additive concentrates containing overbased additives, namely lack of stability giving rise to sedimentation and foaming problems. The problem of EP-A-0094814 is not that of producing phenate additive concentrates having a TBN of greater than 300 and indeed the phenate additive concentrates produced by the process of the invention, although demonstrating overcoming the problems of stability and foaming, have TBN values of less than 300.

It can be concluded that the prior art in which carboxylic acids are employed does not address the problem of producing additive concentrates comprising overbased alkaline earth metal hydrocarbyl phenates having a TBN of greater than 300 and an acceptable viscosity.

Accordingly, in one aspect the present invention provides an additive concentrate suitable for incorporation into a finished lubricating oil composition, the additive concentrate comprising:

(a) a lubricating oil, (b) a lubricating oil soluble sulphurised or non-sulphurised alkaline earth metal hydrocarbyl phenate modified by incorporation of from greater than 2 to less than 40% by weight based on the weight of the composition of either (i) at least one carboxylic acid having the formula:

$$R-\underset{\underset{R^1}{|}}{CH}-COOH \qquad (I)$$

wherein R is a $C_{10}$ to $C_{24}$ alkyl or alkenyl group and $R^1$ is either hydrogen, a $C_1$ to $C_4$ alkyl group or a —$CH_2$—COOH group, or an anhydride, acid chloride or ester thereof or (ii) a di- or polycarboxylic acid containing from 36 to 100 carbon atoms or an anhydride, acid chloride or ester thereof, the composition having a TBN greater than 300.

Component (a) of the composition is a lubricating oil. The lubricating oil may suitably be either an animal oil, a vegetable oil or a mineral oil. Suitably the lubricating oil may be a petroleum-derived lubricating oil, such as a naphthenic base, paraffin base or mixed base oil. Solvent neutral oils are particularly suitable. Alternatively, the lubricating oil may be a synthetic lubricating oil. Suitable synthetic lubricating oils include synthetic ester lubricating oils, which oils include diesters such as di-octyl adipate, di-octyl sebacate and tridecyladipate, or polymeric hydrocarbon lubricating oils, for example liquid polyisobutenes and polyalpha olefins. The lubricating oil may suitably comprise from 10 to 90%, preferably from 10 to 70%, by weight of the composition.

Component (b) is a lubricating oil soluble sulphurised or non-sulphurised, preferably sulphurised, alkaline earth metal hydrocarbyl phenate modified by incorporation of from greater than 2 to less than 40% by weight based on the weight of the composition of either (i) or (ii). Suitably the alkaline earth metal may be strontium, calcium, magnesium or barium, preferably calcium, barium or magnesium, more preferably calcium. The hydrocarbyl phenate moiety of the alkaline earth metal hydrocarbyl phenate is preferably derived from at least one alkyl phenol. The alkyl groups of the alkyl phenol may be branched or unbranched. Suitable alkyl groups contain from 4 to 50, preferably from 9 to 28 carbon atoms. A particularly suitable alkyl phenol is the $C_{12}$-alkyl phenol obtained by alkylating phenol with propylene tetramer.

The alkaline earth metal hydrocarbyl phenate is modified by incorporation of either (i) or (ii). As regards (i), this is at least one carboxylic acid having the formula (I) or an acid anhydride, acid chloride or ester thereof. Preferably R in the formula (I) is an unbranched alkyl or alkenyl group. Preferred acids of formula (I) are those wherein R is a $C_{10}$ to $C_{24}$, more preferably $C_{18}$ to $C_{24}$ straight chain alkyl group and $R^1$ is hydrogen. Examples of suitable saturated carboxylic acids of formula (I) include capric acid, lauric acid, myristic acid, palmitic acid, stearic acid, arachidic acid, behenic acid and lignoceric acid. Examples of suitable unsaturated acids off formula (I) include lauroleic acid, myristoleic acid, palmitoleic acid, oleic acid, gadoleic acid, erucic acid, ricinoleic acid, linoleic acid and linolenic acid. Mixtures of acids may also be employed, for example rape top fatty acids. Particularly suitable mixtures of acids are those commercial grades containing a range of acids, including both saturated and unsaturated acids. Such mixtures may be obtained synthetically or may be derived from natural products, for example cotton oil, ground nut oil, coconut oil, linseed oil, palm kernel oil, olive oil, corn oil, palm oil, castor oil, soyabean oil, sunflower oil, herring oil, sardine oil and tallow. Sulphurised acids and acid mixtures may also be employed. Instead of, or in addition to, the carboxylic acid there may be used the acid anhydride, the acid chloride or the ester derivatives of the acid, preferably the acid anhydride. It is preferred however to use a carboxylic acid or a mixture of carboxylic acids. A preferred carboxylic acid of formula (I) is stearic acid.

Instead of, or in addition to (i), the alkaline earth metal hydrocarbyl phenate may be modified by incorporation of (ii), which is a di- or polycarboxylic acid containing from 36 to 100 carbon atoms or an acid anhydride, acid chloride or ester derivative thereof, preferably an acid anhydride thereof. Preferably (ii) is a polyisobutene succinic acid or a polyisobutene succinic anhydride.

Preferably the carboxylic acid(s) having the formula (I), the di- or polycarboxylic acid, or the acid anhydride, acid chloride or ester thereof is incorporated in an amount from greater than 10% to 35%, more preferably from 12 to 20%, for example about 16% by weight based on the weight of the composition. An advantage of incorporating greater than 10% of the carboxylic acid or derivative thereof is generally a relativelylower concentrate viscosity.

Suitably the alkaline earth metal may be present in the composition in an amount in the range from 10 to 20% by weight based on the weight of the composition.

The alkaline earth metal hydrocarbyl phenate may be either sulphurised or non-sulphurised, preferably sulphurised.

Suitably sulphur may be present in the composition in an mount in the range from 1 to 6, preferably from 1.5 to 3% by weight based on the weight of the composition.

Suitably carbon dioxide may be present in the composition in an amount in the range from 5 to 20, preferably from 9 to 15% by weight based on the weight of the composition.

Preferably the TBN of the composition is greater than 350, more preferably greater than 400.

Suitably the composition may have a viscosity measured at 100° C. of less than 1000 cSt, preferably less than 750 cSt, more preferably less than 500 cSt.

In another aspect the present invention provides an additive concentrate suitable for incorporation into a finished lubricating oil which concentrate is obtainable by reacting at elevated temperature (A) either (i) a hydrocarbyl phenol or (ii) a hydrocarbyl phenol and sulphur, (B) an alkaline earth metal base added in either a single addition or in a plurality of additions at intermediate points during the reaction, (C) either a polyhydric alcohol having from 2 to 4 carbon atoms, a di- or tri- ($C_2$ to $C_4$) glycol, an alkylene glycol alkyl ether or a polyalkylene glycol alkyl ether, (D) a lubricating oil, (E) carbon dioxide added subsequent to the, or each, addition of component (B), and (F) sufficient to provide from greater than 2 to less than 40% by weight based on the weight of the concentrate of either (i) a carboxylic acid having the formula (I) or an acid anhydride, acid chloride or ester thereof or (ii) a di- or polycarboxylic acid containing from 36 to 100 carbon atoms or an acid anhydride, acid chloride or ester thereof, the weight ratio of components (A) to (F) being such as produce a concentrate having a TBN greater than 300.

In yet another aspect the present invention provides a process for the production of an additive concentrate for incorporation into a finished lubricating oil which process comprises reacting at elevated temperature components (A) to (F) as hereinbefore described, the weight ratios of components (A) to (F) being such as to produce a concentrate having a TBN greater than 300.

Component (A) of the reaction mixture is either (i) a hydrocarbyl phenol or (ii) a hydrocarbyl phenol and sulphur. Using component (A) (i) the product is an alkaline earth metal hydrocarbyl phenate and using component (A) (ii) the product is a sulphurised alkaline earth metal hydrocarbyl phenate. The hydrocarbyl phenol employed is that alkyl phenol from which is derived the desired hydrocarbyl phenate moiety as hereinbefore described.

The alkaline earth metal base (component B) may suitably be an alkaline earth metal oxide or hydroxide, preferably the hydroxide. Calcium hydroxide may be added for example in the form of slaked lime. Preferred alkaline earth metals are calcium, magnesium and barium and more preferred is calcium. The alkaline earth metal base must be added in an amount relative to component (A) sufficient to produce a product having a TBN in excess of 300, preferably in excess of 350. This amount will depend on a number of factors including the nature of the sulphurised alkyl phenol and will be higher than the amounts generally employed in prior art processes. Typically, the weight ratio of component (B) to component (A) may suitably be in the range from 0.2 to 50, preferably from 0.4 to 10. The alkaline earth metal base (B) may be added in whole to the initial reactants, or in part to the initial reactants and the remainder in one or more portions at a subsequent stage or stages in the process. In order to produce an additive concentrate having a TBN greater than about 350 and a viscosity at 100° C. of less than 1000 cSt it is particularly desirable to add component (B) in at least two, and preferably more additions and to add component (F) in an amount greater than 10% by weight based on the weight of the additive concentrate product.

Component (C) is either a polyhydric alcohol having from 2 to 4 carbon atoms, a di- or tri- ($C_2$ to $C_4$) glycol alkyl ether. The polyhydric alcohol may suitably be either a dihydric alcohol, for example ethylene glycol or propylene glycol, or a trihydric alcohol, for example glycerol. The di- or tri- ($C_2$ to $C_4$) glycol may suitably be either diethylene glycol or triethylene glycol. The alkylene glycol alkyl ether or polyalkylene glycol alkyl ether may suitably be of the formula:

$$R\,(OR^1)_xOR^2 \qquad \text{(II)}$$

wherein R is a $C_1$ to $C_6$ alkyl group, $R^1$ is an alkylene group, $R^2$ is hydrogen or $C_1$ to $C_6$ alkyl and x is an integer in the range from 1 to 6. Suitable solvents having the formula (II) include the monomethyl or dimethyl ethers of ethylene glycol, diathylene glycol, triethylene glycol or tetraethylene glycol. A particularly suitable solvent is methyl digol ($CH_3OCH_2CH_2OCH_2CH_2OH$). Mixtures of glycols and glycol ethers of formula (II) may also be employed. Using a glycol or glycol ether of formula (II) as solvent it is preferred to use in combination therewith an inorganic halide, for example ammonium chloride, and a lower, i.e. $C_1$ to $C_4$, carboxylic acid, for example acetic acid. Preferably the component (C) is either ethylene glycol or methyl digol, the latter in combination with ammonium chloride and acetic acid.

Component (D) is a lubricating oil as hereinbefore described with reference to the additive concentrate.

Component (E) is carbon dioxide, which may be added in the form of a gas or a solid, preferably in the form of a gas. In gaseous form it may suitably be blown through the reaction mixture. We have found that generally the amount of carbon dioxide incorporated increases with increasing concentrations of component (F). In order to produce a concentrate having a TBN greater than about 350 the carbon dioxide is preferably added subsequent to each of two or preferably more additions of component (B).

Component (F) is either a carboxylic acid of formula (I), a di- or polycarboxylic acid containing from 36 to 100 carbon atoms, or an acid anhydride, an acid chloride or ester thereof as hereinbefore described with reference to the additive concentrate composition. The amount of the aforesaid required to provide from greater than 2 to less than 40% by weight based on the weight of the concentrate will be to a first approximation the amount desired in the concentrate. In calculating this amount allowance should be made for loss of water from carboxylic acids, for example.

The reaction may be performed in the presence of a diluent. Suitable diluents are liquids having a volatility consistent with operation of the process, i.e. having a volatility such that they are readily strippable from the reaction mixture at the conclusion of the reaction. Examples of suitable diluents include 2-ethyl hexanol, iso-octanol, iso-heptanol and tri-decanol.

Preferably the reaction is carried out in the presence of a further component which is a catalyst for the reaction. As catalyst there may be used an inorganic halide which may suitably be either a hydrogen halide, an ammonium halide or a metal halide. Suitably the metal moiety of the metal halide may be zinc, aluminium or an alkaline earth metal, preferably calcium. Of the halides, the chloride is preferred. Suitable catalysts include hydrogen chloride, calcium chloride, ammonium chloride, aluminium chloride and zinc chloride, preferably calcium chloride. Suitably the amount of catalyst employed may be up to 2.0% wt/wt.

Suitably the reaction of components (A)–(F) and also the carbonation reaction may be carried out at elevated temperatures in the range from 120° to 200°, preferably from about 130° to 165° C., though the actual temperatures chosen for the reaction of components (A)–(F) and the carbonation may differ if desired. The pressure may be atmospheric, subatmospheric or superatmospheric.

The concentrate may be recovered by conventional means, for example by distillative stripping of component (C) and diluent (if any).

Finally, it is preferred to filter the concentrate so-obtained. Generally, the process of the invention will produce a concentrate having an acceptable viscosity, that is a viscosity of less than 1000 cSt at 100° C., and can produce concentrates having a viscosity less than 750 or 500 cSt at 100° C. Moreover, the concentrates generally have desirable viscosity index properties. Such viscometric properties are advantageous because they facilitate processing (including filtration) of the concentrate. However, it is also possible to produce concentrates having a higher viscosity than 1000 cSt at 100° C., generally at higher TBN levels. Filtration of such concentrates presents a problem, which may be overcome by adding a diluent prior to filtration and stripping the diluent off after filtration. Alternatively, high viscosity concentrates, for example concentrates having a viscosity at 100° C. greater than 1000 cSt, and also having a high TBN, for example greater than 350, may be diluted by addition of further lubricating oil whilst maintaining a TBN greater than 300, thereby facilitating filtration.

In a final aspect the present invention provides a finished lubricating oil composition which composition comprises a lubricating oil and sufficient of the additive concentrate as hereinbefore described to provide a TBN in the range from 0.5 to 120.

Preferably the finished lubricating oil composition contains sufficient of the additive concentrate to provide a TBN in the range from 0.5 to 100.

The amount of additive concentrate present in the finished lubricating oil will depend on the nature of the final use. Thus, for marine lubricating oils the amount of additive concentrate present may suitably be sufficient to provide a TBN in the range from 9 to 100 and for automobile engine lubricating oils the amount may suitably be sufficient to provide a TBN in the range from 4 to 20.

The finished lubricating oil may also contain effective amounts of one or more other types of conventional lubricating oil additives, for example viscosity index improvers, anti-wear agents, antioxidants, dispersants, rust inhibitors, pour-point depressants, or the like, which may be incorporated into the finished lubricating oil composition either directly or through the intermediary of the concentrate composition.

In addition to their use as additives for incorporation into lubricating oil compositions, the additive concentrate of the present invention may also find application as fuels additives.

The invention will now be further illustrated by reference to the following Examples.

In all the Examples the term "TBN" is used. The TBN is the Total Base Number in mg KOH/g as measured by the method of ASTM D2896.

The viscosity was measured by the method of ASTM D445.

In all the Examples, except otherwise expressly stated, a commercially available $C_{12}$-alkyl phenol obtained by alkylating phenol with propylene tetramer was employed.

EXAMPLE 1

| Charge: | |
|---|---|
| $C_{12}$-alkyl phenol: | 75 g |
| Lubricating oil (100 SN): | 131 g |
| Lime: | 82 g |
| Sulphur: | 23 g |
| Stearic acid: | 70 g |
| Calcium chloride: | 4 g |
| 2-Ethyl hexanol: | 112 g |

Method (a) The charge was heated to 145°–165° C./700 mm Hg whilst adding ethylene glycol (36 g), (b) The mixture was heated at 165° C./700 mm Hg for one hour, (c) Carbon dioxide (40 g) was added at 165° C./1 bar, (d) The mixture was cooled to 125° C./700 mm Hg, (e) Lime (35 g) was added at 125° C./700 mm Hg, (f) The mixture was heated at 165° C./700 mm Hg for one hour, (g) Carbon dioxide (20 g) was added at 165° C./1 bar, (h) The product was then stripped of solvent at 200° C./10 mm Hg, and (i) The product was filtered. The filtration rate was fast.

| Product Weight | |
|---|---|
| Crude Product: | 436 g |
| Distillate: | 169 g |
| Product Composition After Filtration | |
| Calcium: | 14.1% w/w |
| Sulphur: | 2.9% w/w |
| $CO_2$: | 12.4% w/w |
| TBN: | 396 |
| $V_{100}$: | 308 cSt |
| BPHV 150: | 1 |
| Stearic acid: | 16.1% w/w |

This Example demonstrates that a high TBN additive concentrate of acceptable viscosity can be produced in a "double lime addition" process according to the present invention.

EXAMPLE 2

Charge: As for Example A, except that the amount of lime in the charge was increased from 82 g to 117 g corresponding to the total mount of lime added in Example 1 in two additions.

Method

As for Example 1 except that the amount of carbon dioxide added in step (c) was increased from 40 g to 60 g and steps (d), (e), (f) and (g) were omitted. The filtration rate in the final step was slow.

| Product Weight | |
|---|---|
| Crude Product: | 514 g |
| Product Composition After Filtration | |
| Calcium: | 14.1% w/w |
| Sulphur: | 3.0% w/w |
| $CO_2$: | 12.3% w/w |
| TBN: | 390 |
| $V_{100}$: | 7600 cSt |
| Stearic acid: | 13.6% w/w |

This Example demonstrates that an additive concentrate phenate having a high TBN can be produced in a single lime addition process but under the conditions of the Example the viscosity of the product is unacceptable for commercial operation without dilution with lubricating oil.

EXAMPLE 3

Charge: As for Example 1.

Method

As for Example 1, except that in step (g) the amount of carbon dioxide was increased from 20 g to 40 g and the following steps were added after step (g) and before steps (h) and (i):

(j) The mixture was cooled to 120° C.,
(k) Lime (35 g) was added at 120° C.,
(l) The mixture was heated at 165° C./700 mm Hg, and
(m) Carbon dioxide (50 g) was added to the mixture.

| Product Weights | |
|---|---|
| Crude Product: | 484 g |
| Distillate: | 169 g |
| Product Composition After Filtration | |
| Calcium: | 15.8% w/w |
| Sulphur: | 2.6% w/w |
| $CO_2$: | 15.0% w/w |
| TBN: | 439 |
| $V_{100}$: | 506 cSt |
| Stearic acid: | 14.5% w/w |

This Example demonstrates that high TBN additive concentrates can be produced by the process of the invention by a triple lime addition.

EXAMPLE 4

Charge: As for Example 1 except that the amount of lubricating oil was reduced from 131 g to 158 g and the amount of stearic acid was reduced from 70 g to 43 g.

Method

As for Example 1 except that in step (d) the mixture was cooled to 135° C. instead of 125° C.

| Product Weights | |
|---|---|
| Crude Product: | 442 g |
| Distillate: | 155 g |
| Product Composition After Filtration | |
| Calcium: | 14.1% w/w |
| Sulphur: | 2.9% w/w |
| $CO_2$: | 11.9% w/w |
| TBN: | 393 |
| $V_{100}$: | 3440 cSt |
| Stearic acid: | 9.8% w/w |

This Example demonstrates by comparison with Example 1 that although a high TBN product can be produced at an acid level less than 10% w/w the viscosity of the product is high.

EXAMPLE 5

| Charge: | |
|---|---|
| $C_{12}$-alkylphenol: | 35.3 g |
| Lubricating oil (SN 100): | 131 g |
| Sulphur: | 14.7 g |
| Calcium chloride: | 4.0 g |
| Stearic acid: | 109.1 g |
| 2-Ethyl hexanol: | 224 g |

Method (a) The mixture was heated to 120° C.,
(b) Lime (82 g) was added at 120° C./120° C./2" Hg vacuum,
(c) Ethylene glycol (36 g) was added at 145°–165° C./2" Hg,
(d) The mixture was held at 165° C./2" Hg for 1 hour,
(e) Carbon dioxide (40 g) was added,
(f) The mixture was cooled to 130° C. and lime (35 g) added at 130° C./2" Hg,
(g) The mixture was held at 165° C./2" Hg for 1 hour,
(h) Carbon dioxide (20 g) was added at 165° C.,
(i) Solvent was stripped from the product at 200° C./30" Hg, and (J) The product was filtered.

| Product Weights | |
|---|---|
| Crude Product: | 397 g |
| Distillate: | 245 g |
| **Product Composition After Filtration** | |
| Calcium: | 13.6% w/w |
| Sulphur: | 1.2% w/w |
| $CO_2$: | 13.9% w/w |
| TBN: | 376 |
| $V_{100}$: | 142 cSt |
| $V_{40}$: | 1881 cSt |
| VI: | 180 |
| Carboxylic acid: | 27.5% w/w |

This Example demonstrates that a high TBN product having an acceptable viscosity can be obtained using a stearic acid addition of 27.5% w/w based on the weight of the final product.

EXAMPLE 6

Charge: As for Example 5 except that the amount of $C_{12}$-alkylphenol was reduced from 35.3 g to 15.6 g and the amount of stearic acid was increased from 109.1 g to 128.7 g.

Method

As for Example 5.

| Product Weights | |
|---|---|
| Crude Product: | 416 g |
| Distillate: | 242 g |
| **Product Composition After Filtration** | |
| Calcium: | 14.5% w/w |
| Sulphur: | 1.0% w/w |
| $CO_2$: | 13.6% w/w |
| TBN (mg KOH/g): | 395 |
| $V_{100}$: | 255 cSt |
| $V_{40}$: | 3100 cSt |
| VI: | 221 |
| Stearic acid: | 30.9% w/w |

This Example demonstrates that a high TBN product can be obtained at a stearic acid content of 30.9% w/w.

EXAMPLES 7 to 13

Charge: As shown in the Table.

Method (a) A mixture of alkyl phenol, lubricating oil, calcium chloride, stearic acid and 2-ethyl hexanol was heated to 120° C./700 mm Hg, (b) Lime was added at 120° C./700 mm Hg, (c) Ethylene glycol was added at 145° to 165° C./700 mm Hg and the mixture was held at 165° C./700 mm Hg for one hour, (d) Carbon dioxide was added at 165° C./1 bar, (e) Solvent was recovered at 200° C./10 mm Hg, and (f) The product was filtered.

Product Weights

As shown in the Table.

Product Composition After Filtration

As shown in the Table.

The Examples demonstrate that an additive concentrate having a TBN greater than 300 can be produced in a single lime addition process over a range of stearic acid contents from 2.6 to 29.7% w/w based on the weight of the concentrate.

TABLE

| Example | 7 | 8 | 9 | 10 | 11 | 12 | 13 |
|---|---|---|---|---|---|---|---|
| Stearic Acid Content of Product (% w/w) | 2.6 | 7.7 | 12.9 | 18.2 | 18.0 | 23.0 | 29.7 |
| **Charge Weights (g)** | | | | | | | |
| Lube oil | 131 | 131 | 131 | 131 | 131 | 131 | 131 |
| $C_{12}$ Alkyl Phenol | 135 | 115 | 95 | 75 | 75 | 55 | 36 |
| Lime | 82 | 82 | 82 | 82 | 82 | 82 | 85 |
| Sulphur | 23 | 23 | 23 | 23 | 23 | 23 | 15 |
| Stearic Acid | 10 | 30 | 50 | 70 | 70 | 90 | 113 |
| $CaCl_2$ | 4 | 4 | 4 | 4 | 4 | 4 | 4 |
| 2-EH | 112 | 112 | 112 | 112 | 112 | 112 | 112 |
| Ethylene Glycol | 36 | 36 | 36 | 36 | 36 | 36 | 36 |
| $CO_2$ | 28 | 28 | 28 | 28 | 40 | 40 | 40 |
| Product wt (g) | 389 | 391 | 386 | 385 | 389 | 391 | 382 |
| Distillate wt (g) | 158 | 159 | — | — | — | — | — |
| **Composition After Filtration** | | | | | | | |
| Calcium (%) | 11.2 | 11.0 | 11.1 | 11.2 | 11.0 | 11.1 | 11.1 |
| Sulphur (%) | 3.7 | 3.6 | 3.4 | 3.0 | 3.0 | 2.7 | 1.6 |
| $CO_2$ (%) | 6.5 | 6.9 | 7.1 | 6.5 | 8.2 | 10.8 | 10.2 |
| TBN | 314 | 310 | 311 | 310 | 308 | 312 | 302 |
| $V_{100}$ (cSt) | 286 | 190 | 163 | 160 | 109 | 128 | 84 |

EXAMPLE 14

| Charge: | |
|---|---|
| $C_{12}$-aklyl phenol: | 64 g |
| Lubricating oil (SN 100): | 111 g |
| Sulphur: | 20 g |
| Stearic acid: | 59 g |
| Calcium chloride: | 4 g |
| 2-Ethyl hexanol: | 190 g |

Method (a) The charge was heated to 120° C./700 mm Hg, (b) Lime (70 g) was added, (c) The mixture was heated from 145° C. to 165° C./700 mm Hg whilst adding ethylene glycol (32 g), (d) The mixture was held at 165° C./700 mm Hg for 5 minutes, (e) Carbon dioxide (44 g) was added at 165° C./1 bar, (f) The mixture was cooled to 120° C. and lime (60 g) was added, (g) The mixture was held at 165° C./700 mm Hg for 5 minutes, (h) Carbon dioxide (44 g) was added at 165° C./1 bar, (i) Solvent was recovered from the product by stripping at 200° C./10 mm Hg, and (j) The product was filtered.

| Product Weights | |
|---|---|
| Crude Product: | 408 g |
| Distillate: | 245 g |
| **Product Composition After Filtration** | |
| Calcium: | 16.0% w/w |
| Sulphur: | 2.6% w/w |
| $CO_2$: | 14.6% w/w |
| TBN: | 450 |

-continued

| | |
|---|---|
| $V_{100}$: | 488 cSt |
| Stearic acid: | 14.5% w/w |

This Example demonstrates that an additive concentrate having a TBN as high as 450 and an acceptable viscosity can be produced by the process of the invention.

EXAMPLE 15

| Charge: | |
|---|---|
| $C_{12}$-alkyl phenol: | 64 g |
| Lubricating oil (SN 100): | 111 g |
| Sulphur: | 20 g |
| Stearic acid: | 59 g |
| Acetic acid: | 2 g |
| Ammonium chloride: | 3 g |
| Methyl diglycol: | 40 g |

Method (a) The charge was heated to 120° C./100 mm Hg,
(b) Lime (70 g) was added,
(c) The mixture was heated from 145° C. to 165° C./700 mm Hg whilst adding methyl diglycol (90 g),
(d) The mixture was held at 165° C./700 mm Hg for 1 hour,
(e) Carbon dioxide (34 g) was added,
(f) The mixture was cooled to 120° C. and lime (30 g) was added,
(g) The mixture was held at 165° C./700 mm Hg for 1 hour,
(h) Carbon dioxide (17 g) was added,
(i) Solvent was recovered by stripping at 200° C./10 mm Hg, and
(j) The product was filtered.

| Product Weights | |
|---|---|
| Crude Product: | 361 g |
| Distillate: | 146 g |
| **Product Composition After Filtration** | |
| Calcium: | 14.1% w/w |
| Sulphur: | 2.7% w/w |
| $CO_2$: | 12.4% w/w |
| TBN: | 394 |
| $V_{100}$: | 164 cSt |
| Stearic acid: | 16.3% w/w |

This Example demonstrates that methyl diglycol can be used as component (C) and that ammonium chloride can be used as the catalyst in the process of the invention.

EXAMPLE 16

| Charge: | |
|---|---|
| $C_{12}$-alkyl phenol: | 64 g |
| Lubricating oil (SN 100): | 73 g |
| $C_{18}$-linear alpha-olefin: | 38 g |
| Sulphur: | 23 g |
| Stearic acid: | 59 g |
| Calcium chloride: | 3 g |
| 2-Ethyl hexanol: | 190 g |

Method

As for Example 15 except that in step (c) instead of methyl diglycol (90 g) there was used ethylene glycol (31 g) and in steps (d) and (g) the mixture was held at 165° C./700 mm Hg for 10 minutes instead of 1 hour.

| Product Weights | |
|---|---|
| Crude Product: | 373 g |
| Distillate: | 239 g |
| **Product Composition After Filtration** | |
| Calcium: | 14.4% w/w |
| Sulphur: | 2.3% w/w |
| $CO_2$: | 13.3% w/w |
| TBN: | 405 |
| $V_{100}$: | 460 cSt |
| Stearic acid: | 15.8% w/w |

This Example demonstrates that a long carbon-chain alpha-olefin can be incorporated in the reaction.

EXAMPLE 17

Charge: As for Example 16 except that instead of the $C_{18}$-alpha-olefin (38 g) there was used a polyisobutene having an $M_n$ of 500 (38 g).

Method

As for Example 16.

| Product Weights | |
|---|---|
| Crude Product: | 363 g |
| Distillate: | 246 g |
| **Product Composition After Filtration** | |
| Calcium: | 14.3% w/w |
| Sulphur: | 2.8% w/w |
| $CO_2$: | 13.8% w/w |
| TBN: | 406 |
| $V_{100}$: | 697 cSt |
| $V_{40}$: | 26,600 cSt |
| VI: | 175 |
| Stearic acid: | 16.3% w/w |

This Example demonstrates that a polyisobutene can be incorporated in the reaction.

EXAMPLE 18

| Charge: | |
|---|---|
| $C_{12}$-alkyl phenol: | 55.2 g |
| Lubricating oil (SN 100): | 131 g |
| Sulphur: | 23 g |
| Calcium Chloride: | 4 g |
| Tallow Fatty Acid: | 89.8 g |
| 2-Ethyl hexanol: | 112 g |

Method

As lot Example 5 except that steps (f), (g) and (h) were omitted, i.e. a single lime addition process.

| Product Weights | |
|---|---|
| Crude Product: | 396 g |
| Distillate: | 151 g |
| **Product Composition After Filtration** | |
| Calcium: | 10.8% w/w |
| Sulphur: | 3.1% w/w |
| $CO_2$: | 11.3% w/w |

-continued

| | |
|---|---|
| TBN: | 305 |
| $V_{100}$: | 388 cSt |
| $V_{40}$: | 20,000 cSt |
| VI: | 101 |
| Carboxylic acid: | 22.7% w/w |

This Example demonstrates that a high TBN additive concentrate can be obtained using a Tallow Fatty Acid.

Comparison Test

| Charge: | |
|---|---|
| $C_{12}$-alkyl phenol: | 75 g |
| Lubricating oil (SN 100): | 131 g |
| Sulphur: | 23 g |
| Calcium chloride: | 4 g |
| Acetic acid: | 15 g |
| 2-Ethyl hexanol: | 112 g |

Method

As for Example 5 (a)–(d). Thereafter the mixture became a thick heterogeneous mass. Stirring was ineffective and the mixture gelled on cooling. The reaction was discontinued.

This Test demonstrates that acetic acid can not be used as the carboxylic acid in the process of the invention.

EXAMPLE 19

| Charge: | |
|---|---|
| $C_{12}$-alkyl phenol: | 135 g |
| Lubricating oil (SN 100): | 131 g |
| Lime: | 82 g |
| Sulphur: | 23 g |
| Stearic acid: | 10 g |
| Calcium chloride: | 4 g |

Method (a) The charge van heated to 145° C./700 mm Hg and iso-octanol (112 g) was added, (b) The mixture was heated from 145° C. to 165° C./700 mm Hg and ethylene glycol (36 g) was added, (c) The mixture was held at 165° C./700 mm Hg for 1 hour, (d) Carbon dioxide (28 g) was added at 165° C./1 bar, (e) Solvent was recovered by stripping at 210° C./10 mm Hg, and (f) The product was filtered.

| Product Weights | |
|---|---|
| Crude Product: | 380 g |
| Distillate: | 144 g |
| Product Composition After Filtration | |
| Calcium: | 10.8% w/w |
| Sulphur: | 3.6% w/w |
| $CO_2$: | 6.0% w/w |
| TBN: | 301 |
| $V_{100}$: | 216 cSt |
| Stearic acid: | 2.6% w/w |

We claim:

1. A process for the production of an additive concentrate having a viscosity of less than 1000 cSt at 100° C., which process comprises reacting at elevated temperature and in the presence of a catalyst selected from the group consisting of an inorganic halide and calcium acetate (A) either (i) a hydrocarbyl phenol or (ii) a hydrocarbyl phenol and sulphur, (B) an alkaline earth metal base added in either a single addition or in a plurality of additions during the reaction, (C) either a polyhydric alcohol having from 2 to 4 carbon atoms, a di- or tri- $C_2$ to $C_4$ glycol, an alkylene glycol alkyl ether or a polyalkylene glycol alkyl ether, (D) a lubricating oil, (E) carbon dioxide added subsequent to the, or each, addition of compound (B), and (F) sufficient to provide from 12 to less than 40% by weight based on the weight of the concentrate of either (i) a carboxylic acid having the formula (I)

$$R-\underset{\underset{R^1}{|}}{CH}-COOH \qquad (I)$$

wherein R is a $C_{10}$ to $C_{24}$ alkyl or alkenyl group and $R^1$ is either hydrogen, a $C_1$ to $C_4$ alkyl group or a —$CH_2$—COOH group, or an anhydride, acid chloride or ester thereof or (ii) a di- or polycarboxylic acid containing from 36 to 100 carbon atoms or an anhydride, acid chloride or ester thereof, the weight ratios of components (A) to (F) being such as to produce a concentrate having a TBN greater than 350.

2. A process according to claim 1, wherein component (B) is lime.

3. A process according to claim 1, wherein the weight ratio of component (B) to component (A) is in the range from 0.4 to 10.

4. A process according to claim 1, wherein component (C) is ethylene glycol.

5. A process according to claim 1, wherein component (C) is methyl digol.

6. A process according to claim 1, wherein the carbon dioxide (component E) is added subsequent to each of two or more additions of component (B).

7. A process according to claim 1, wherein a diluent is present.

8. A process according to claim 1 wherein the catalyst is an inorganic halide.

9. A process according to claim 8 wherein the catalyst is calcium chloride.

10. A process according to claim 1, wherein the TBN is greater than 400.

11. A process according to claim 1, wherein there is incorporated either a carboxylic acid of formula (I) as defined in claim 1 or a di- or polycarboxylic acid containing 36 to 100 carbon atoms or an anhydride, acid chloride or ester thereof in amount from 12 to 20% by weight based on the weight of the concentrate.

12. A process according to claim 11 wherein said carboxylic acid of formula (I) or said di- or polycarboxylic acid containing from 36 to 100 carbon atoms or said anhydride, acid chloride or ester thereof are incorporated in an amount of about 16% by weight based on the weight of the concentrate.

13. A process according to claim 1, wherein the viscosity at 100° C. is less than 750 cSt.

14. A process according to claim 1, wherein the viscosity at 100° C. is less than 500 cSt.

15. A process for the production of an additive concentrate having a viscosity of less than 1000 cSt at 100° C., which process comprises reacting at elevated temperature and in the presence of a catalyst selected from the group consisting of an inorganic halide and a lower alkanoate (A) either (i) a hydrocarbyl phenol or (ii) a hydrocarbyl phenol and sulphur, (B) an alkaline earth metal base added in either a single addition or in a plurality of additions during the reaction, (C)

either a polyhydric alcohol having from 2 to 4 carbon atoms, a di- or tri- $C_2$ to $C_4$ glycol, an alkylene glycol alkyl ether or a polyalkylene glycol alkyl ether, (D) a lubricating oil, (E) carbon dioxide added subsequent to the, or each, addition of compound (B), and (F) sufficient to provide from 12 to 20% by weight based on the weight of the concentrate of either (i) a carboxylic acid having the formula (I)

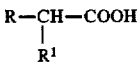

(I)

wherein R is a $C_{10}$ to $C_{24}$ alkyl or alkenyl group and $R^1$ is either hydrogen, a $C_1$ to $C_4$ alkyl group or a —$CH_2$—COOH group, or an anhydride, acid chloride or ester thereof or (ii) a di- or polycarboxylic acid containing from 36 to 100 carbon atoms or an anhydride, acid chloride or ester thereof, the weight ratios of components (A) to (F) being such as to produce a concentrate having a TBN greater than 350.

16. A process for the production of an additive concentrate having a viscosity of less than 1000 cSt at 100° C., which process comprises reacting at elevated temperature and in the presence of a catalyst selected from the group consisting of an inorganic halide and calcium acetate (A) either (i) a hydrocarbyl phenol or (ii) a hydrocarbyl phenol and sulphur, (B) an alkaline earth metal base added in either a single addition or in a plurality of additions during the reaction, (C) either a polyhydric alcohol having from 2 to 4 carbon atoms, a di- or tri- $C_2$ to $C_4$ glycol, an alkylene glycol alkyl ether or a polyalkylene glycol alkyl ether, (D) a lubricating oil, (E) carbon dioxide added subsequent to the, or each, addition of compound (B), and (F) sufficient to provide from 12 to 35% by weight based on the weight of the concentrate of either (i) a carboxylic acid having the formula (I)

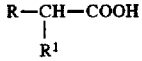

(I)

wherein R is a $C_{10}$ to $C_{24}$ alkyl or alkenyl group and $R^1$ is either hydrogen, a $C_1$ to $C_4$ alkyl group or a —$CH_2$—COOH group, or an anhydride, acid chloride or ester thereof or (ii) a di- or polycarboxylic acid containing from 36 to 100 carbon atoms or an anhydride, acid chloride or ester thereof, the weight ratios of components (A) to (F) being such as to produce a concentrate having a TBN greater than 350.

17. A process for the production of an additive concentrate having a viscosity of less than 1000 cSt at 100° C., which process comprises reacting at elevated temperature and in the presence of a catalyst selected from the group consisting of an inorganic halide and calcium acetate (A) either (i) a hydrocarbyl phenol or (ii) a hydrocarbyl phenol and sulphur, (B) an alkaline earth metal base added in either a single addition or in a plurality of additions during the reaction, (C) either a polyhydric alcohol having from 2 to 4 carbon atoms, a di- or tri- $C_2$ to $C_4$ glycol, an alkylene glycol alkyl ether or a polyalkylene glycol alkyl ether, (D) a lubricating oil, (E) carbon dioxide added subsequent to the, or each, addition of compound (B), and (F) sufficient to provide from about 16% by weight based on the weight of the concentrate of either (i) a carboxylic acid having the formula (I)

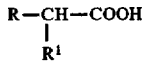

(I)

wherein R is a $C_{10}$ to $C_{24}$ alkyl or alkenyl group and $R^1$ is either hydrogen, a $C_1$ to $C_4$ alkyl group or a —$CH_2$—COOH group, or an anhydride, acid chloride or ester thereof or (ii) a di- or polycarboxylic acid containing from 36 to 100 carbon atoms or an anhydride, acid chloride or ester thereof, the weight ratios of components (A) to (F) being such as to produce a concentrate having a TBN greater than 350.

* * * * *